US012279666B2

(12) United States Patent
Sethi et al.

(10) Patent No.: US 12,279,666 B2
(45) Date of Patent: Apr. 22, 2025

(54) DUAL HELMET

(71) Applicants: Anupama Sethi, Bangalore (IN); Arvind Sethi, Bangalore (IN)

(72) Inventors: Arvind Sethi, Bangalore (IN); Rohan Vinodkumar Sharma, Ahmedabad (IN); Prayas Rokde, Bhopal (IN); Sudhir Sanandan, Ahmedabad (IN); Avi Sethi, Bangalore (IN)

(73) Assignees: Anupama Sethi, Bangalore (IN); Arvind Sethi, Bangalore (IN)

( * ) Notice: Subject to any disclaimer, the term of this patent is extended or adjusted under 35 U.S.C. 154(b) by 52 days.

(21) Appl. No.: 17/923,165

(22) PCT Filed: May 3, 2021

(86) PCT No.: PCT/IB2021/053677
§ 371 (c)(1),
(2) Date: Nov. 3, 2022

(87) PCT Pub. No.: WO2021/224755
PCT Pub. Date: Nov. 11, 2021

(65) Prior Publication Data

US 2023/0157401 A1 May 25, 2023

(30) Foreign Application Priority Data

May 4, 2020 (IN) ..... 202041018993

(51) Int. Cl.
*A42B 3/12* (2006.01)
*A42B 3/00* (2006.01)
(Continued)

(52) U.S. Cl.
CPC ..... *A42B 3/127* (2013.01); *A42B 3/003* (2013.01); *A42B 3/06* (2013.01); *A42B 3/063* (2013.01);
(Continued)

(58) Field of Classification Search
CPC .... A42B 3/06; A42B 3/10; A42B 3/12; A42B 3/127; A42B 3/324; A42B 3/326;
(Continued)

(56) References Cited

U.S. PATENT DOCUMENTS 1,080,690 A * 12/1913 Hipkiss ..... A42B 3/00 2/412
3,186,004 A * 6/1965 Carlini ..... A42B 3/122 D29/106
(Continued)

FOREIGN PATENT DOCUMENTS

| | | | |
|---|---|---|---|
| ES | 2705745 | B8 | 7/2019 |
| JP | 3183063 | U | 4/2013 |
| WO | 2019/222510 | A1 | 11/2019 |

OTHER PUBLICATIONS

International Preliminary Report on Patentability received for PCT Patent Application No. PCT/IB2021/053677, mailed on Nov. 17, 2022, 9 pages.
(Continued)

*Primary Examiner* — Khaled Annis
*Assistant Examiner* — Dakota Marin
(74) *Attorney, Agent, or Firm* — Amit Kulkarni

(57) ABSTRACT

The present disclosure relates to a dual helmet that can be easily converted into two sets of helmets having protective cushioning, and which are comfortable, yet strong, safe, and up to the required standards. The helmet includes a first shell and a second shell defining a shell of a first helmet and a second helmet, respectively. The second shell is removably disposed over the first shell such that the helmet can be used as a single combine helmet when the shells are together, and further, the second shell can be separated from the first shell to form two separate helmets. The helmet includes a first cushion disposed within the first shell, and a second cushion for the second helmet being removably configured within
(Continued)

the first cushion such that the second cushion can be separated by slightly bending it, and later can be configured with the second shell to form the second helmet and the first helmet, as required.

10 Claims, 9 Drawing Sheets

(51) Int. Cl.
*A42B 3/06* (2006.01)
*A42B 3/10* (2006.01)
*A42B 3/32* (2006.01)

(52) U.S. Cl.
CPC ..... *A42B 3/065* (2013.01); *A42B 3/069* (2013.01); *A42B 3/10* (2013.01); *A42B 3/12* (2013.01); *A42B 3/324* (2013.01); *A42B 3/326* (2013.01)

(58) Field of Classification Search
CPC ..... A42B 3/003; A42B 3/063; A42B 3/065; A42B 3/069
USPC ..... 2/411
See application file for complete search history.

(56) References Cited

U.S. PATENT DOCUMENTS 3,447,163 A * 9/1969 Tojeiro ..... A42B 3/065 428/116
3,882,546 A * 5/1975 Morton ..... A42B 3/12 264/222
4,599,752 A * 7/1986 Mitchell ..... A42B 3/32 2/425
5,010,598 A * 4/1991 Flynn ..... A42B 3/227 2/909
5,887,289 A * 3/1999 Theoret ..... A42B 3/003 2/425
5,896,587 A * 4/1999 Gentry ..... A42B 3/08 2/12
6,094,750 A * 8/2000 Lee ..... A42B 3/281 2/412
6,339,849 B1 * 1/2002 Nelson ..... A42B 3/00 2/425
7,096,512 B2 * 8/2006 Blair ..... A42B 1/08 2/425
8,640,267 B1 * 2/2014 Cohen ..... A42B 3/063 2/411
8,782,819 B1 * 7/2014 Culpepper ..... A42B 3/10 2/410
RE45,459 E * 4/2015 Hersick ..... A42B 3/062 2/5
9,572,390 B1 * 2/2017 Simpson ..... A42B 3/125
9,867,416 B2 1/2018 Woolf
10,342,282 B2 7/2019 Salvetti et al.
10,542,788 B2 * 1/2020 Simpson ..... A42B 3/128
10,757,995 B2 * 9/2020 Jacobsen ..... A42B 3/063
10,881,161 B2 * 1/2021 Jacobsen ..... A42B 3/283
10,905,187 B1 * 2/2021 Bochner ..... A42B 3/322
2001/0032351 A1 * 10/2001 Nakayama ..... A42B 3/064 2/412
2006/0000009 A1 * 1/2006 Fleming ..... A42B 3/00 2/412
2006/0031978 A1 * 2/2006 Pierce ..... A42B 3/283 2/414
2006/0112477 A1 * 6/2006 Schneider ..... A42B 3/12 2/412
2007/0056071 A1 * 3/2007 Smith ..... A42B 3/12 2/5
2007/0130673 A1 * 6/2007 Wasserkrug ..... A42B 3/12 2/411
2008/0060117 A1 * 3/2008 Timms ..... A42B 3/12 2/171
2010/0043126 A1 * 2/2010 Morel ..... A42B 3/32 2/421
2013/0340146 A1 * 12/2013 Dekker ..... A42B 3/12 2/411
2014/0223641 A1 * 8/2014 Henderson ..... A42B 3/065 2/411
2014/0237706 A1 * 8/2014 O'Conner ..... A42B 1/08 2/410
2015/0089725 A1 * 4/2015 Lowe ..... A42B 3/125 2/410
2015/0223546 A1 * 8/2015 Cohen ..... A42B 3/127 2/412
2018/0255862 A1 * 9/2018 Ho ..... A42B 3/064
2019/0029357 A1 * 1/2019 Bochner ..... A42B 3/322
2019/0269193 A1 * 9/2019 Benyola ..... A42B 3/044

OTHER PUBLICATIONS

International Search Report and Written Opinion received for PCT Patent Application No. PCT/IB2021/053677, mailed on Aug. 9, 2021, 10 pages.

* cited by examiner

DUAL HELMET

TECHNICAL FIELD

The present disclosure relates to the field of protective headwear. More particularly, the present disclosure relates to a protective helmet that can be easily converted into two sets of helmets having protective cushioning, and which are comfortable, yet strong, safe, and up to the required industrial standards.

BACKGROUND

Background description includes information that may be useful in understanding the present invention. It is not an admission that any of the information provided herein is prior art or relevant to the presently claimed invention, or that any publication specifically or implicitly referenced is prior art.

Protective helmets and headwear are known to protect a wearer's head from accidental trauma. For example, helmets are strictly required to be worn by users/riders of two-wheeled vehicles around the world, as they are most prone to accidents. Further, construction workers are often required to wear hard hats or other safety headwear due to the increased risk of falling objects in and around construction sites. Similarly, athletes are required to wear protective helmets, such as football, baseball, hockey, lacrosse, skiing, snowboarding, skydiving, and cycling helmets, to protect their heads in case of high impact collisions.

Two-wheeler vehicular accidents account for the highest number of road accidents and deaths around the world. There are strict advisories by different jurisdictions across the globe, for the riders of two-wheelers vehicles, to wear helmets. Further, there are strict standards for the type and attributes of the helmet, which are to be followed and maintained while manufacturing the helmets. Otherwise, such helmets that are not following and maintaining these standards are not allowed to be manufactured or worn by riders while driving. Only the certified helmets, which are up to the standards are allowed to be manufactured and used by riders.

Various types of certification standards followed by helmet manufacturers around the world are the Department of Transportation (DOT), Indian Standard Institute (ISI), Economic Commission for Europe (ECE), and SNELL. The helmets undergo various safety tests including impact test, penetration test, and rigidity test, before being approved up to the standards and allowed to be worn by riders on road. All the tests are done by the manufacturers themselves. If a helmet fails the safety tests, the entire batch of the helmets is removed from the market. In addition, there are some penalties that can be imposed on the manufacturer if the helmets are no up to the standards.

Typical helmets available in the market are made considering the important impact zones of the head, that the rider may witness at the time of accidents. Basically, there is four impact zone on the head, that is considered the most important. These include the forehead, top head, ear, and rear head. The typical helmet includes a rigid outer shell defining a shell exterior and a shell interior, which is configured to be worn on the wearer's (rider's) head and extend to protectively cover the head circumferentially and vertically over the top of the wearer's skull. The helmet \includes an impact absorber line disposed under the rigid outer shell. Further, multiple comfort-fit paddings are disposed of within the absorber line, above the most important impact zones of the rider's head, and face (chin). The helmet is provided with a face shield to protect the rider from dust and wind. Further, a retention system is provided in the helmet to maintain the helmet over the rider's head.

Two-wheeler vehicles are mostly ridden by one to two riders. The first rider being the driver of the vehicle and the second rider being the person sitting behind the driver. In general practice, the driver of the vehicle is used to wear a helmet, however, the person sitting behind the driver generally does not wear any helmet. This irresponsible practice had diluted the strict advisories of the jurisdictions to reduce the number of fatal accidents and death caused due to two-wheeler road accidents.

However, the recent strict advisories in India and around the world have forced both the riders to wear helmets that are up to the standards. This has led to the use of two different helmets by the riders while riding the vehicle. With such restrictions and advisories, it has become difficult for the riders to carry two helmets with them, as the space for storing the helmets in their vehicle is limited to only one. Vehicles such as scooty are provided with space under the seat. However, the space under the seat is limited to store just one helmet. Further, motorbikes have space to hang just one helmet.

In many cases, a single rider (driver of the vehicle) is accompanied by another rider on-road or in between, without any notice. Even though the driver was carrying his/her helmet, the second rider cannot ride with the driver, as in the general case, the single rider does not carry an additional helmet.

There is, therefore, a need to provide a protective helmet that can be easily and quickly converted into two sets of helmets having different protective cushioning, and which are comfortable, yet strong, safe, and up to the required industrial standards.

OBJECTS OF THE PRESENT DISCLOSURE

Some of the objects of the present disclosure, which at least one embodiment herein satisfies are as listed herein below.

It is an object of the present disclosure to protect a driver as well as secondary pillion rider of a vehicle, specifically two-wheeler vehicles, from an accident.

It is an object of the present disclosure to provide a strong and reliable protective helmet that can be easily and quickly converted into two sets of helmets having protective cushioning.

It is an object of the present disclosure to provide a protective helmet that can be easily converted into two sets of helmets having protective cushioning, and which are comfortable, yet strong, safe, and up to the required industrial standards.

It is an object of the present disclosure to provide a compact yet comfortable cushioning means for a helmet, which can be easily and quickly converted into two sets of cushions for two different helmets when required.

It is an object of the present disclosure to provide a cushioning means comprising two cushions being removably configured with one another, wherein the two cushions are having an efficient design that allows them to form a single, compact yet comfortable cushion when configured together.

It is an object of the present disclosure to provide a compact and efficient retention system for helmets, which can be easily and quickly converted into two sets of retention straps for two different helmets when required.

SUMMARY

The present disclosure relates to a protective helmet that can be easily converted into two sets of helmets having protective cushioning, and which are comfortable, yet strong, safe, and up to the required industrial standards.

An aspect of the present disclosure pertains to a dual helmet adapted to be transformed into two separate helmets. The dual helmet may comprise a first shell that may be adapted to be worn over the head of users, and extending circumferentially and vertically over the head of the users. The dual helmet may further comprise a second shell that may be adapted to be removably configured over the first shell such that at least a section of the second shell is adapted to move between a first position and a second position. The first position may correspond to an expanded position where the second shell is expanded to facilitate separation of the second shell from the first shell, and the second position may correspond to a retracted position where the second shell is retracted and adapted to be configured over any of the first shell, and the head of the use. Further, the dual helmet may comprise a protective cushion arrangement adapted to be configured on an inner surface of the first shell. The protective cushion arrangement may comprise a first cushion adapted to be configured on the inner surface of the first shell, and a second cushion adapted to be removably configured within any of the first cushion, and an inner surface of the second shell.

Accordingly, when the second shell is separated from the first shell, the first cushion may be configured on the inner surface of the first shell to form a first helmet, and the second cushion may be configured on the inner surface of the second shell to form a second helmet. Further, when the second shell is configured over the first shell, the protective cushion arrangement may be configured on the inner surface of the first shell to form a combined helmet.

In an aspect, the first cushion may comprise a first set of protrusions being positioned at a predefined position on an inner surface of the first cushion such that a first set of depressions are formed between the first set of protrusions. Further, the second cushion may comprise a second set of protrusions being positioned at a predefined position on an inner surface of the second cushion such that a second set of depressions are formed between the second set of protrusions. Accordingly, when the second cushion is configured within the first cushion to form the protective cushion arrangement, the first set of protrusions of the first cushion may engage with the second set of depressions of the second cushion, and the second set of protrusions of the second cushion may engage with the first set of depressions of the first cushion.

In an aspect, the first helmet and/or the second helmet may comprise a lock arrangement to facilitate the locking of the first helmet and the second helmet to form the combined helmet. In an aspect, the dual helmet may comprise a comfort foam adapted to be removably configured and disposed within any or a combination of the first cushion, and the second cushion, and wherein the dual helmet comprises a face protector adapted to be removably coupled to any or a combination of the first helmet, the second helmet, and the combined helmet.

In an aspect, the dual helmet may comprise a first strap and a second strap removably coupled to each other to form a combined strap, and may be adapted to retain any or a combination of the first helmet, the second helmet, and the combined helmet, respectively, over the head of users. The first strap may be adapted to be configured with the first helmet, the second strap may be adapted to be configured with the second helmet, and the combined strap may be adapted to be configured with the combined helmet. Further, each of the first strap and the second strap may comprise ear cavities to accommodate the ears of the users.

BRIEF DESCRIPTION OF DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure. The diagrams are for illustration only, which thus is not a limitation of the present disclosure.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
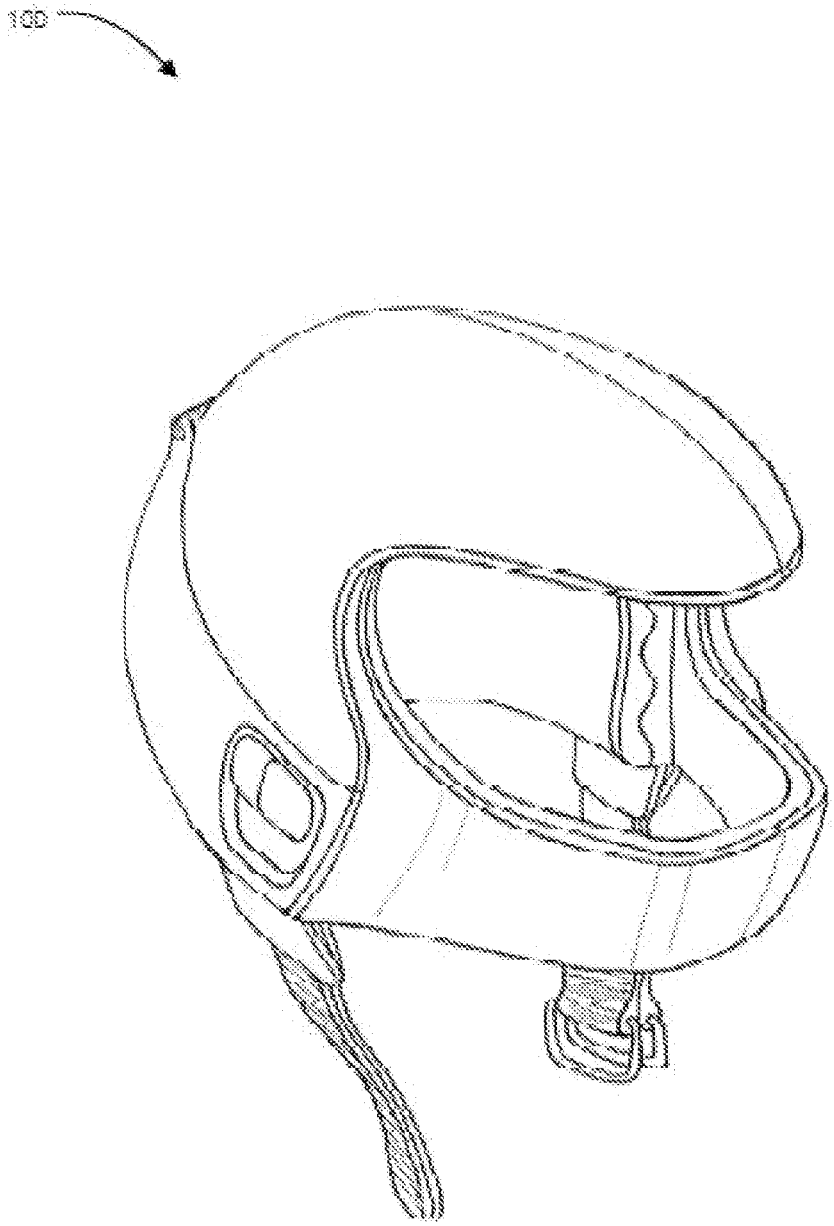
FIG. 1A illustrates an exemplary view of a first embodiment of the proposed dual helmet having a face guard or chin guard, in a combined state, in accordance with an embodiment of the present invention.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

In the following description, numerous specific details are set forth in order to provide a thorough understanding of embodiments of the present invention. It will be apparent to one skilled in the art that embodiments of the present invention may be practiced without some of these specific details.

If the specification states a component or feature "may", "can", "could", or "might" be included or have a characteristic, that particular component or feature is not required to be included or have the characteristic.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The use of "including", "comprising" or "having" and variations thereof herein is meant to encompass the items listed thereafter and equivalents thereof as well as additional items. The terms "a" and "an" herein do not denote a limitation of quantity, but rather denote the presence of at least one of the referenced items. Further, the use of terms "first", "second", and "third", and the like, herein do not denote any order, quantity, or importance, but rather are used to distinguish one element from another.

The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

Exemplary embodiments will now be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

The present disclosure relates to a protective helmet that can be easily converted into two sets of helmets having protective cushioning, and which are comfortable, yet strong, safe, and up to the required industrial standards.

According to an aspect, the present disclosure elaborates upon a dual helmet adapted to be transformed into two separate helmets. The dual helmet can include a first shell that can be adapted to be worn over the head of users, and extending circumferentially and vertically over the head of the users. The dual helmet can further include a second shell that can be adapted to be removably configured over the first shell such that at least a section of the second shell is adapted to move between a first position and a second position. The first position can correspond to an expanded position where the second shell is expanded to facilitate separation of the second shell from the first shell, and the second position can correspond to a retracted position where the second shell is retracted and adapted to be configured over any of the first shell, and the head of the use. Further, the dual helmet can include a protective cushion arrangement adapted to be configured on an inner surface of the first shell. The protective cushion arrangement can include a first cushion adapted to be configured on the inner surface of the first shell, and a second cushion adapted to be removably configured within any of the first cushion, and an inner surface of the second shell. Accordingly, when the second shell is separated from the first shell, the first cushion can be configured on the inner surface of the first shell to form a first helmet, and the second cushion can be configured on the inner surface of the second shell to form a second helmet. Further, when the second shell is configured over the first shell, the protective cushion arrangement can be configured on the inner surface of the first shell to form a combined helmet.

In an embodiment, the first cushion can include a first set of protrusions being positioned at a predefined position on an inner surface of the first cushion such that a first set of depressions are formed between the first set of protrusions. In another embodiment, the second cushion can include a second set of protrusions being positioned at a predefined position on an inner surface of the second cushion such that a second set of depressions are formed between the second set of protrusions. Accordingly, when the second cushion is configured within the first cushion to form the protective cushion arrangement, the first set of protrusions of the first cushion can engage with the second set of depressions of the second cushion, and the second set of protrusions of the second cushion can engage with the first set of depressions of the first cushion.

In an embodiment, at least one of the first cushion, and the second cushion can be adapted to be bend, to facilitate removal of the second cushion from the first cushion.

In an embodiment, the first helmet and/or the second helmet can include a lock arrangement to facilitate the locking of the first helmet and the second helmet to form the combined helmet. Further, the lock arrangement can facilitate the locking of the second helmet in the second position.

In an embodiment, the dual helmet can include a first strap and a second strap removably coupled to each other to form a combined strap, and can be adapted to retain any or a combination of the first helmet, the second helmet, and the combined helmet, respectively, over the head of users. The first strap can be adapted to be configured with the first helmet, the second strap can be adapted to be configured with the second helmet, and the combined strap is adapted to be configured with the combined helmet. Further, each of the first strap and the second strap can include ear cavities to accommodate the ears of the users.

In an embodiment, the dual helmet can include a comfort foam adapted to be removably configured and disposed within any or a combination of the first cushion, and the second cushion, and wherein the dual helmet includes a face protector adapted to be removably coupled to any or a combination of the first helmet, the second helmet, and the combined helmet.

Referring to FIGS. 1A to 1H, the proposed dual helmet 100 (also referred to helmet 100, or combined helmet 100, herein) can be converted into two separate helmets namely a first helmet 102-1 and a second helmet 102-2, and further reconverted and combined into the dual helmet 102.

Figure 1B:
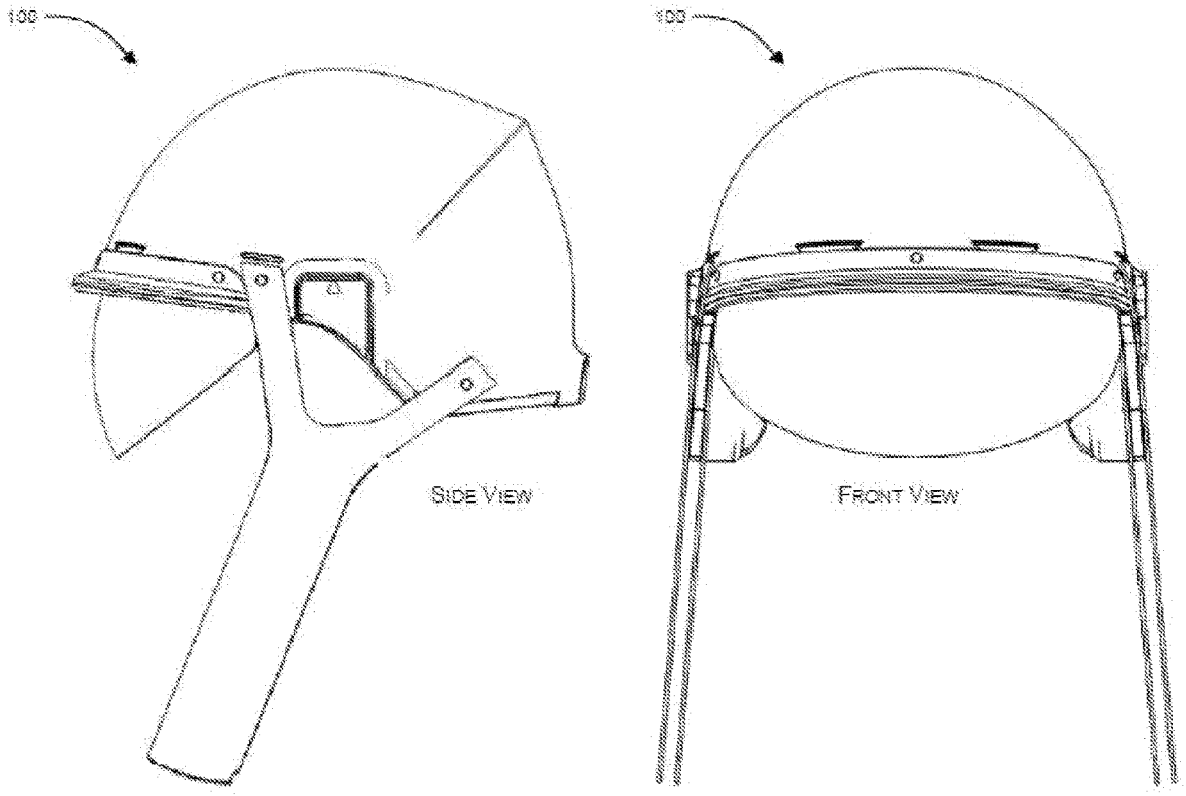
FIG. 1B illustrates an exemplary side view and front view of a second embodiment of the proposed dual helmet without a face guard or chin guard, in a combined state, in accordance with an embodiment of the present invention
Figure 1C:
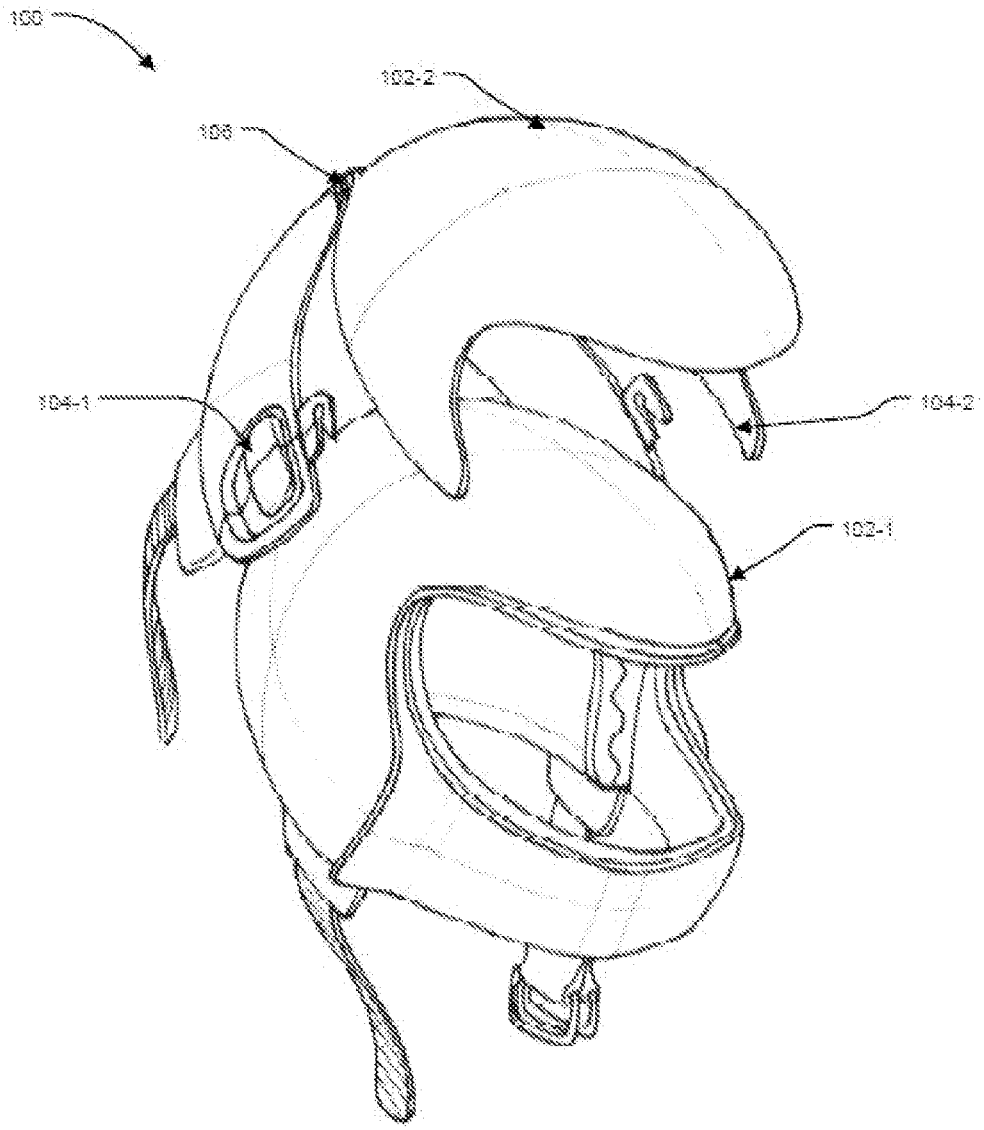
FIG. 1C illustrates an exemplary view of the proposed dual helmet of FIG. 1A being separated into a first helmet and a second helmet.
Figure 1D:
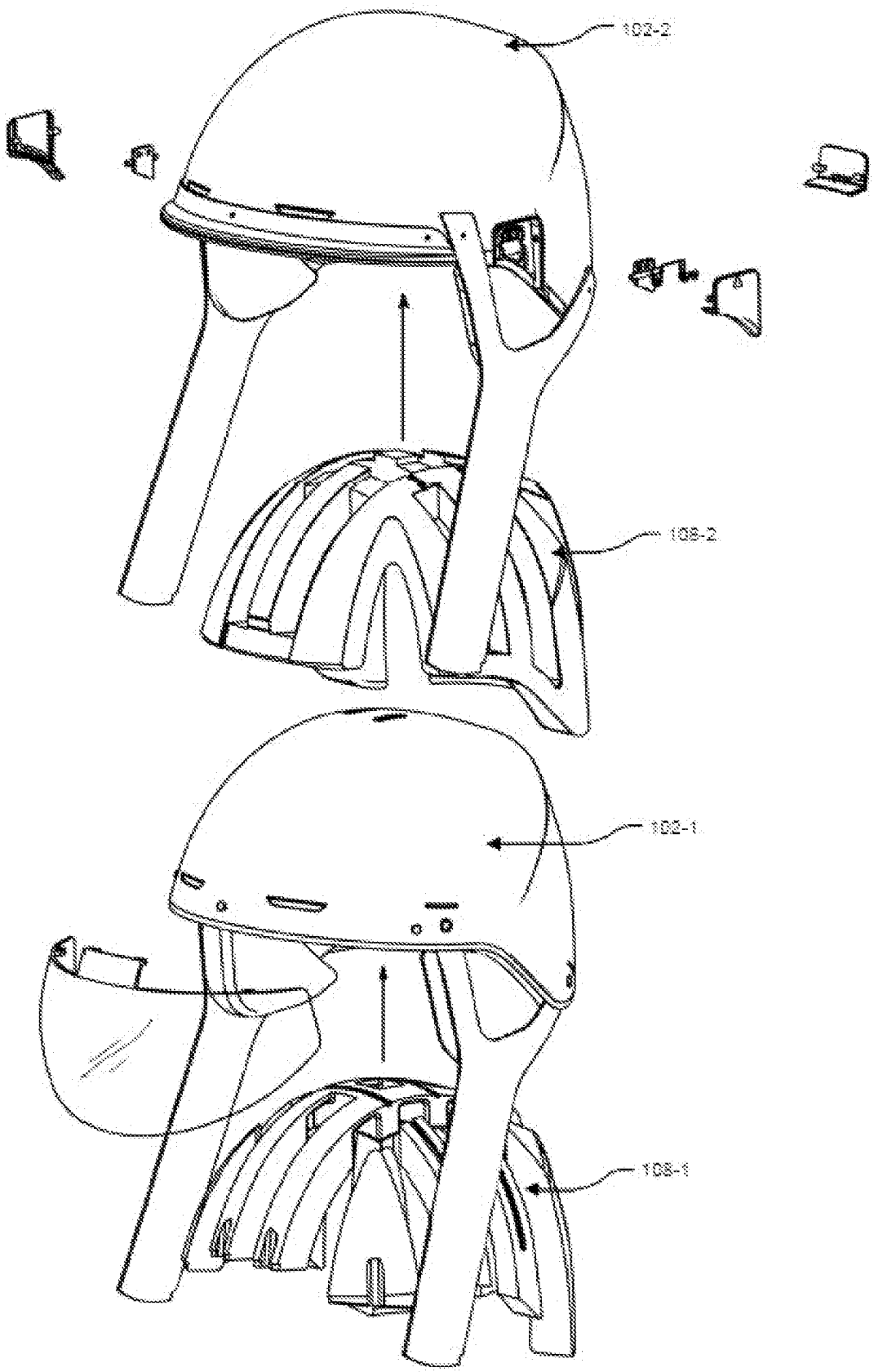
FIG. 1D illustrates an exemplary view of the proposed dual helmet of FIG. 1B being separated into a first helmet and a second helmet.
Figure 1E:
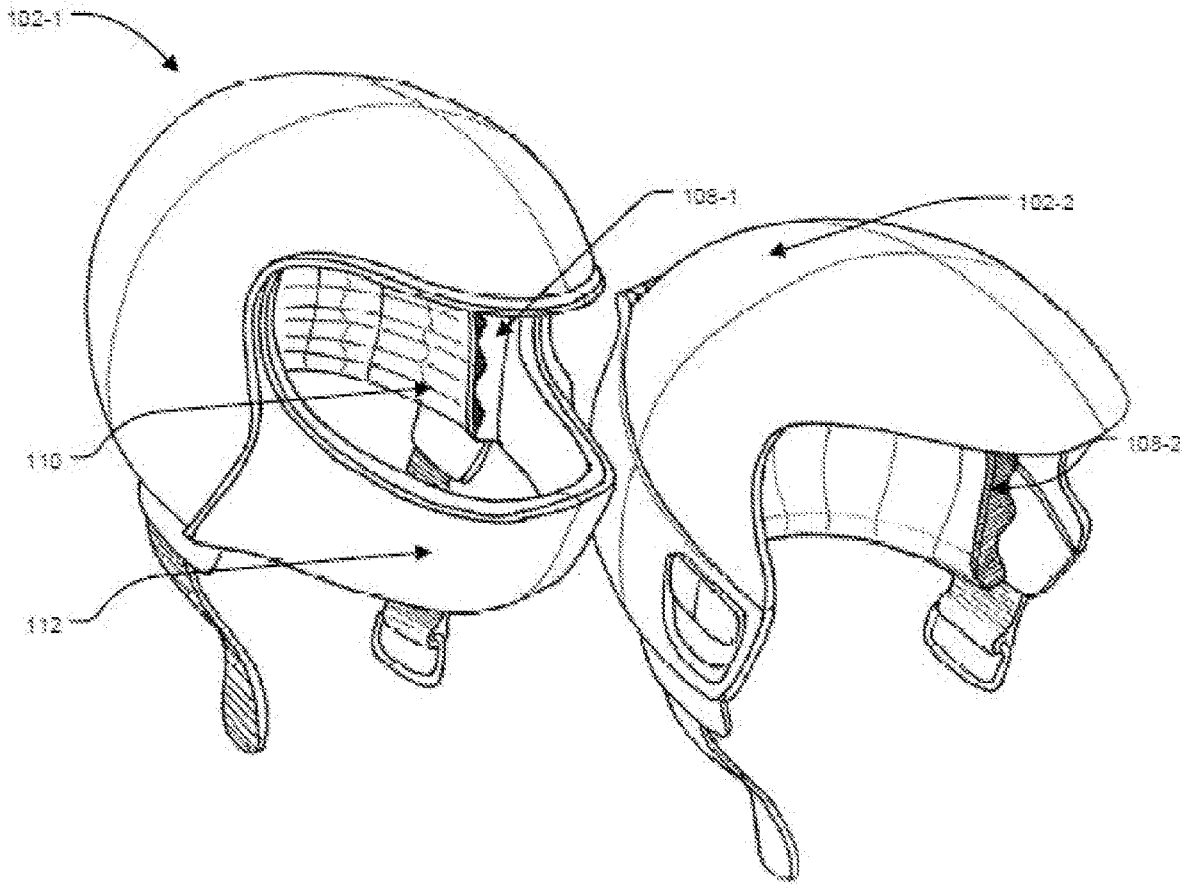
FIG. 1E illustrates an exemplary view of the first helmet and the second helmet of FIG. 1A being completely separated from each other.
Figure 1F:
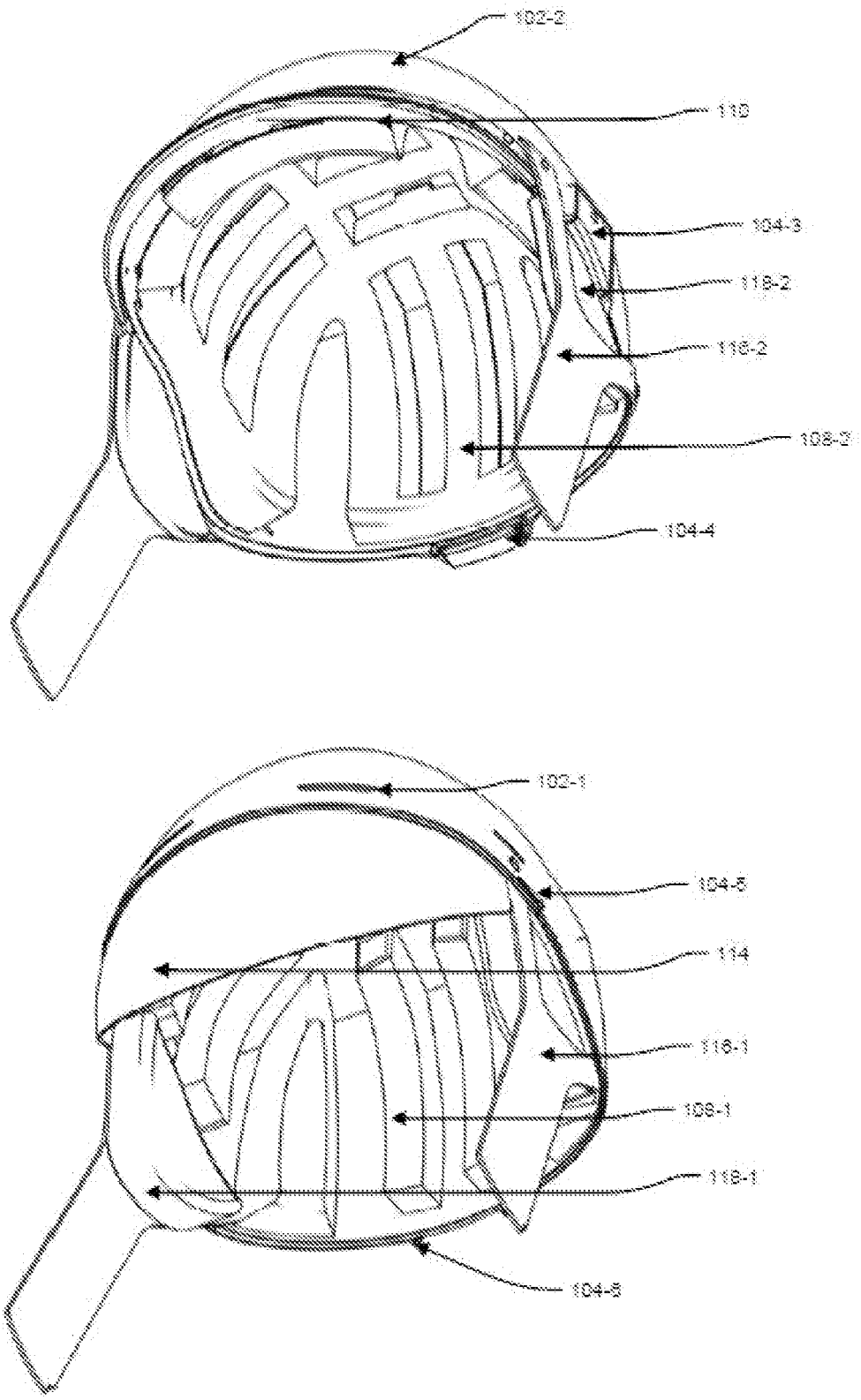
FIG. 1F illustrates an exemplary view of the first helmet and the second helmet of FIG. 1B being completely separated from each other.
Figure 1G:
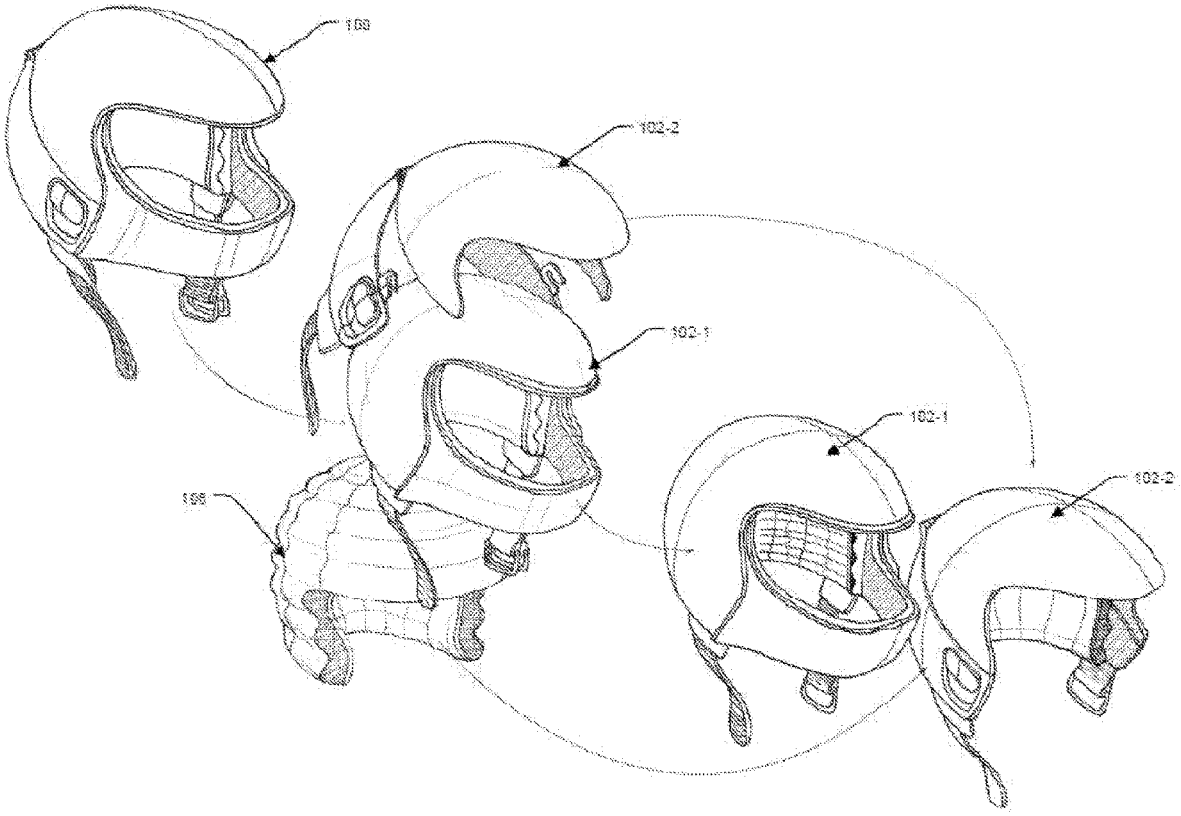
FIG. 1G illustrates an exemplary combined view of the FIGS. 1A, 1C, and 1E.
Figure 1H:
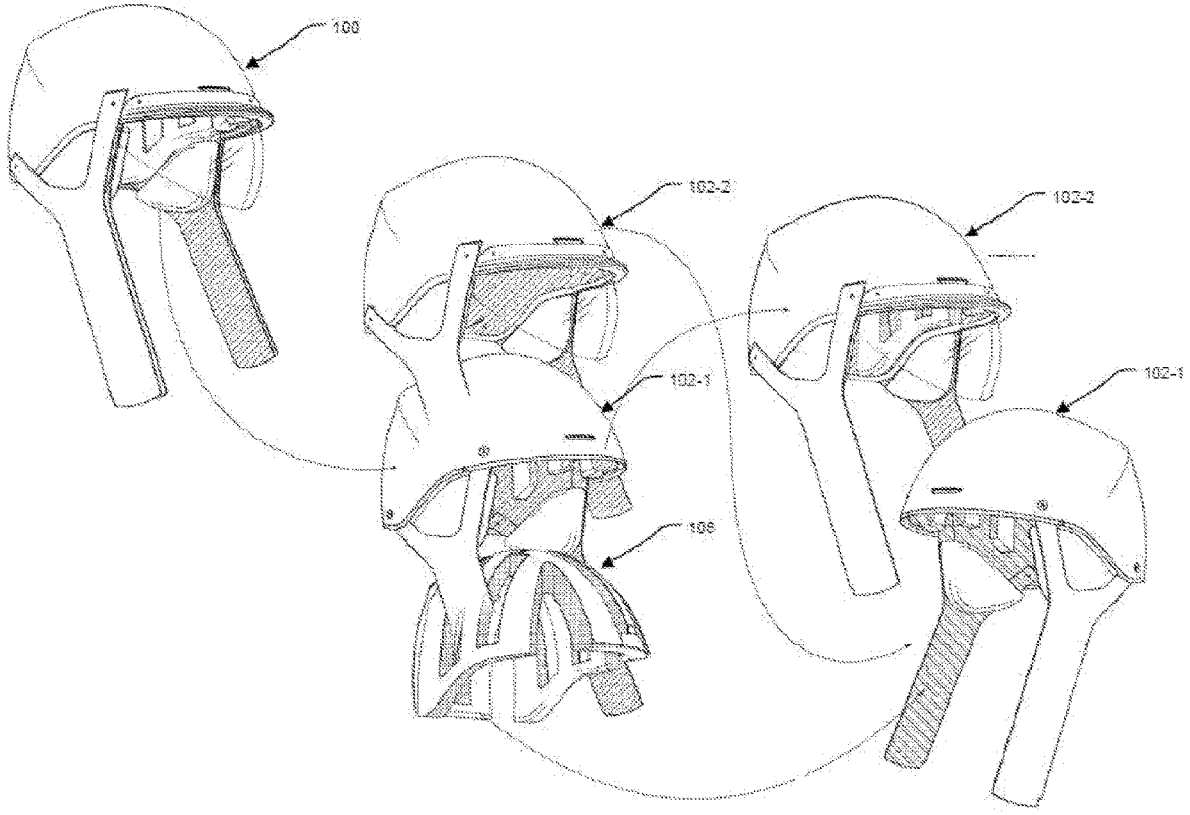
FIG. 1H illustrates an exemplary combined view of the FIGS. 1B, 1D, and 1F.

In an embodiment, the proposed helmet 100 can be configured to be transformed into a combined helmet 100 as shown in FIGS. 1A and 1B, and a separated state as shown in FIGS. 1E and 1F, where the combined helmet 100 is separated into the first helmet 102-1 and the second helmet 102-2. The helmet 100 can include a first shell (also designated as 102-1, herein) and a second shell (also designated as 102-2, herein) removably configured with each other, and defining a shell of the first helmet 102-1 and the second helmet 102-2, respectively. The dual helmet 100 (in the combined state), as well as the first helmet 102-1 and the second helmet 102-2 (in the separated state), can be configured to be worn on wearer's (also referred to as a rider or user, herein) head and can extend to protectively cover the head circumferentially and vertically over the top of wearer's skull as well as protect chin and face of the wearer.

Referring to FIGS. 1C, and 1D, in an embodiment, the second helmet 102-2 can have the second shell 102-2 being removably configured over the first shell 101-1 such that at least a section of the second shell 102-2 of the second helmet 102-2 can be expanded to facilitate separation of the second helmet 102-2 from the first helmet 102-1, thereby separating the dual helmet 100 into two separate helmets. The second shell 102-2 of the second helmet can again be retracted back from the expanded state, once the second helmet 102-2 is separated from the first helmet 102-1. The second helmet 102-2 can be provided with locks 104-1, 104-2 to facilitate the locking of the sections of the second shell of the second helmet 102-2 to keep the second helmet 102-2 in the retracted state.

In an exemplary embodiment, as illustrated in FIG. 1C, the second shell 102-2 of the second helmet 102-2 can be expanded and separated into two sections, which can be hinged to each other at least at one point 106.

In an exemplary embodiment, as illustrated in FIG. 1C, the locks 104-1, 104-2 can facilitate the locking of the second helmet 102-2 over the first shell of the first helmet 102-1, when the dual helmet is used as a single helmet in the combined state. Further, the locks 104-1, 104-2 can also facilitate the locking of the second shell to form the second helmet 102-2, when the dual helmet is converted into two sets of helmets.

In another exemplary embodiment, as illustrated in FIG. 1F, the second helmet 102-2 can include a set of locking mechanisms 104-3, and 104-4 at left/right sides, and bottom-back side, respectively, of the second helmet 102-2. Further, the first helmet 102-1 can include a set of lock guides 104-5, and 104-6 at left/right sides, and bottom-back side, respectively, of the first helmet 102-1. The set of locking mechanism 104-3, and 104-4 can be adapted to engage and lock in the set of lock guides 104-5, and 104-6, to enable locking of the first helmet 102-1 and the second helmet 102-2 together to provide the combined helmet 100.

In an embodiment, the dual helmet 100 can include a first cushion 108-1 (also referred to as first protective cushioning or first foam, herein) and a second cushion 108-2 (also referred to as second protective cushioning or second foam, herein), being removably configured together, and disposed within the first shell such that the first cushion 108-1 and the second cushion 108-2 can function as a single cushion (also referred to as a protective cushion arrangement, herein) when the dual helmet 100 is used a single helmet (combined helmet 100) in the combined state.

In an embodiment, the first cushion 108-1 can be permanently or removably disposed of within the first shell 102-1, and the second cushion 108-2 can be removably configured within the first cushion 108-1. Further, the second cushion 108-2 can be removed from the first cushion 108-1, and can be configured within the second shell 102-2 of the second helmet 102-2 to provide the first helmet 102-1 and the second helmet 102-2, each having a different cushion, and which are up to the required industrial standards.

In an embodiment, the helmet 100 can include a comfort foam 110 removably configured and disposed of within the first cushion 108-1 and/or the second cushion 108-2 to provide additional comfort to the wearer. In another embodiment, as illustrated in FIGS. 1A, 1C, 1E, and 1G, the first helmet 102-1 and or the second helmet 102-2 can include a face guard 112 (also referred to as chin guard, herein) being configured with the corresponding shells to protect the face as well as the chin of the wearer from shock and accident. The face guard 112 can also be provided with a comfort foam on the inner side, to provide comfort as well as protection to the wearer.

In yet another embodiment, as illustrated in FIGS. 1B, 1D, 1E, and 1H, the helmets 102-1 and 102-2 can include a visor 114 made of a transparent material to protect the wearer from wind, dust, water, and sunlight. The visor 114 can be movably configured with the helmets 102-1, and/or 102-2 to allow the wearer to adjust the visor 114 as required. The first helmet 102-1, and the second helmet 102-2 can include a front cap guide 110 to fix the visor 114 to the corresponding helmets.

In an embodiment, impact foams can be coupled to the first cushion 108-1 and the second cushion 108-2, as well as the face guard 112 to provide additional impact protection to the first helmet 102-1, and the second helmet 102-2.

The dual helmet 100 can include the second shell associated with the second helmet 102-2, on the extreme outer side of the dual helmet 100. The helmet can include the first shell 102-1 associated with the first helmet 102-1, being disposed of within the second shell. The helmet 100 can further include the first cushion 108-1 associated with the first helmet 102-1, being configured within the first shell 102-1.

In an embodiment, the second cushion 108-2 associated with the second helmet 102-2 can be removably configured within the first cushion 108-1, such that the second cushion 108-2 can be easily separated from the first cushion 108-1 by slightly bending the second cushion 108-2 or the first cushion 108-1. In another embodiment, the second cushion 108-1 can again be configured with the first cushion 108-2 to form a combined foam 108, or combined cushion when the dual helmet is used as a combined helmet 100.

In an embodiment, the dual helmet 100 can include the comfort foam 110 being disposed of within the second cushion 108-2. In another embodiment, the first helmet 102-1 can include ear foam paddings 118-1, and the second helmet 102-2 can include ear foam paddings 118-2, to provide comfort to ears of the wearer, and protect the ears of the wearer from shock and accidents.

Referring to FIG. 1F, in an embodiment, the dual helmet can include a first strap 116-1 and a second strap 116-2 being removably coupled to each other to form a combined strap, using Velcro, but not limited to the like. The first strap 116-1 can be associated with the first helmet 102-1, and the second strap 116-2 can be associated with the second helmet 102-2, to facilitate keeping any or a combination of the dual helmet 100, the first helmet 102-1 and the second helmet 102-4, over the head of the wearers.

In an exemplary embodiment, the material for the first shell 102-1, the second shell 102-2, the face guard 112 can be selected from a group of materials including fiberglass, carbon fiber, polycarbonate, composite fiver, plastic, metal, alloys, and Kevlar, but not limited to the likes.

In an embodiment, an inner lining of the first shell 102-1 and the outer shell 102-2 can be provided with any or a combination of Styrofoam and koroyd, but not limited to the likes, having the capability to absorb impacts.

In an embodiment, the retention system can include two sets of straps being riveted to the first shell 102-1 and the second shell 102-2 associated with the first helmet and the second helmet, respectively. In an embodiment, the set of straps can include one or more engaging means such as but not limited to rivets to couple the set of straps to the first shell 102-1 and the second shell 102-2. The two sets of straps can be coupled to each other using Velcro, and the likes, when the helmet is used as a combined helmet. The two sets of straps can be separated and used as a separate retention system for the first helmet 102-1 and the second helmet 102-2, when the dual helmet is used in a separated state.

In an embodiment, the straps can include a set of foam pieces being configured with the straps of the retention system. The straps can include ear cavities to accommodate the ears of the wearer. The retention system can further include a set of locks to maintain and fix the helmet over the head of the wearers.

In an embodiment, the set of foams can be separated from the retention system and can be used as a comfort foam for and around the ear of the wearer of the helmets. In an exemplary embodiment, the set of foams can be configured with Velcro to facilitate coupling of the set of foams to the part of the helmet around the ear of the wearer of the second helmet.

In an embodiment, the first cushion 108-1 can be permanently or removably disposed of within the first shell 102-1, and the second cushion 108-2 can be removably configured and disposed of within the first cushion 108-2. In an embodiment, an inner surface of the first cushion 108-1 facing the second cushion 108-2 can have a zigzag arrangement of a first set of protrusions (also referred to as first male engaging means, herein) being positioned at predefined positions such that a first set of depressions (also referred to as first female engaging means, herein) are formed between the first set of protrusions. Further, a surface of the second cushion 108-2 facing the first cushion 108-1 can have a zigzag arrangement of a second set of protrusions (also referred to as second male engaging means, herein) at predefined positions such that a second set of depressions (also referred to as second female engaging means, herein) are formed between the first set of protrusions.

Figure 2:
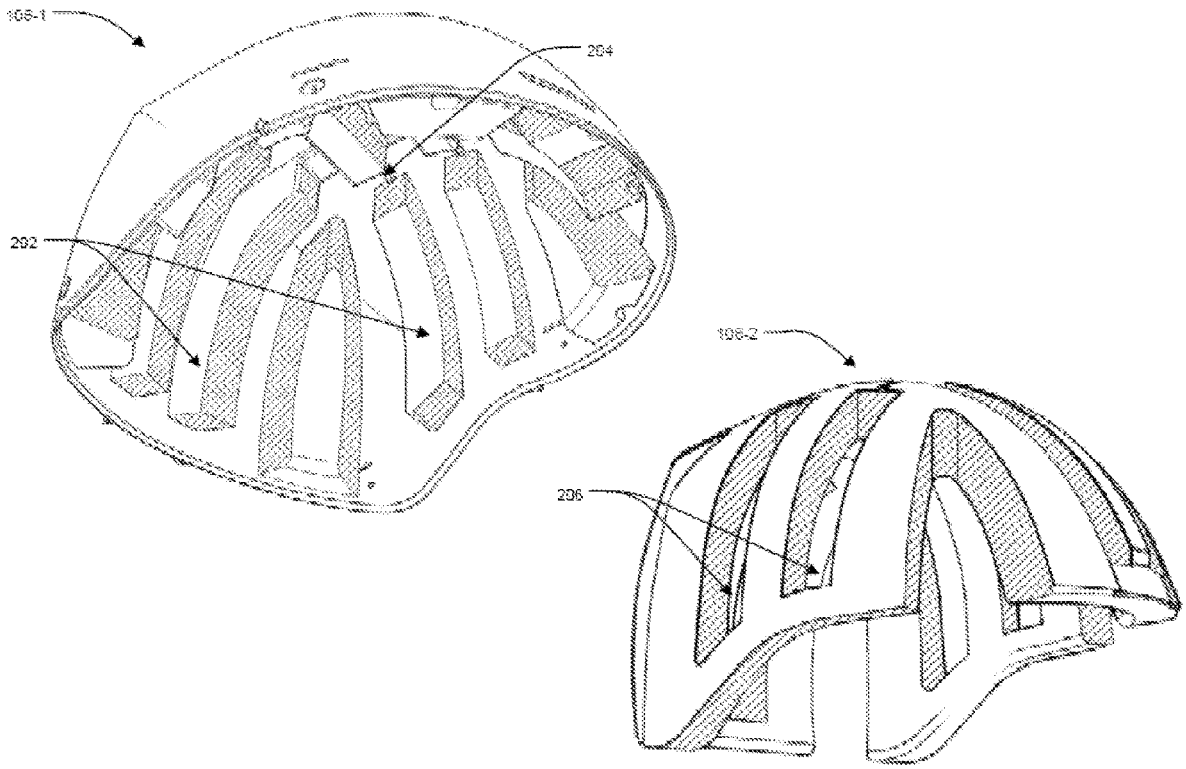
FIG. 2 illustrates an exemplary view of the first cushion and the second cushion of the proposed dual helmet, in accordance with an embodiment of the present invention.

In an implementation, as shown in FIG. 2, when the helmet 100 is in the combined state, the first set of protrusions of the first cushion 108-1 can engage with the second set of depressions of the second cushion 108-2, and the second set of protrusions of the second cushion 108-2 can engage with the first set of depressions of the first cushion 108-1, thereby joining the two cushion 108-1, 108-2 together to form the cushioning 108.

As illustrated in FIG. 2, the second cushion 108-2 can be a structure adapted to be fit between the second shell 102-2 associated with the second helmet 102-2, and the first cushion 108-1. In an embodiment, the structure of the second cushion 108-2 can have a second set of depressions 206 or cut sections 206 (also referred to as the second female engaging means 206, herein) being configured at predefined positions around the structure of the second cushion 108-2.

In an embodiment, the bending of the second cushion 108-2 can facilitate the pulling out or removal of the second cushion 108-2 from the first cushion 108-1. In an embodiment, the second cushion 108-2 can include strings 204 being configured within the structure of the second cushion 108-2 to facilitate bending of the second cushion 108-2 to remove the second cushion 108-2 from the first cushion 108-1.

In an exemplary embodiment, the structure of the second cushion 108-2 can be made of a material selected from polystyrene, and Styrofoam, but not limited to the likes.

Further, the first cushion 108-1 can be a structure adapted to fit within the first shell 102-1 associated with the first helmet 102-1. The structure of the first cushion 108-1 can be adapted to accommodate the second cushion 108-2, when required. In an embodiment, the structure of the first cushion 108-1 can have a first set of protrusions 202 (also referred to as first male engaging means 202, herein) being configured at predefined positions around the structure of the first cushion 108-1.

In an exemplary embodiment, the structure of the first cushion 108-1 can be made of a material selected from polystyrene, and Styrofoam, but not limited to the likes.

In an implementation, when the dual helmet 100 is in the combined state, the first male engaging means 202 associated with first cushion 108-1 can engage with the second female engaging means 206 associated with the second cushion 108-1, to facilitate coupling of the second cushion 108-2 within the first cushion 108-1.

As used herein, and unless the context dictates otherwise, the term "coupled to" is intended to include both direct coupling (in which two elements are coupled to each other or in contact each other) and indirect coupling (in which at least one additional element is located between the two elements). Therefore, the terms "coupled to" and "coupled with" are used synonymously. Within the context of this document terms "coupled to" and "coupled with" are also used euphemistically to mean "communicatively coupled with" over a network, where two or more devices are able to exchange data with each other over the network, possibly via one or more intermediary device.

Moreover, in interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages of the Present Invention

The present invention protects a driver as well as secondary pillion rider of a vehicle, specifically two-wheeler vehicles, from an accident.

The present invention provides a strong and reliable protective helmet that can be easily and quickly converted into two sets of helmets having protective cushioning.

The present invention provides a protective helmet that can be easily converted into two sets of helmets having protective cushioning, and which are comfortable, yet strong, safe, and up to the required industrial standards.

The present invention provides a compact yet comfortable cushioning means for a helmet, which can be easily and quickly converted into two sets of cushions for two different helmets when required.

The present invention provides a cushioning means comprising two cushions being removably configured with one another, wherein the two cushions are having an efficient design that allows them to form a single, compact yet comfortable cushion when configured together.

The present invention provides a compact and efficient retention system for helmets, which can be easily and quickly converted into two sets of retention straps for two different helmets when required.

We claim:

1. A dual helmet transformable into two separate helmets, the dual helmet comprising:

a first shell to be worn on head of users, and extending circumferentially and vertically over the head of the users;

a second shell removably configured over the first shell such that at least a section of the second shell moves between a first position and a second position, wherein the first position corresponds to an expanded position where the second shell is removed to facilitate separation of the second shell from the first shell, and the second position corresponds to a retracted position where the second shell is retracted and configured over any of the first shell, and the head of the user; and a protective cushion arrangement positioned on an inner surface of the first shell, wherein the protective cushion arrangement comprises:

a first cushion disposed on the inner surface of the first shell, and a second cushion removably disposed within the first cushion;

wherein, when the second shell is separated from the first shell, the first cushion along with the first shell forms a first helmet, and the second cushion is removed from the first cushion and positioned on an inner surface of the second shell to form a second helmet so as to allow two users to respectively and simultaneously use the first and the second helmet; and wherein, when the second shell is positioned over the first shell, the first and the second cushion are positioned on the inner surface of the first shell so as to form a single combined helmet.

2. The dual helmet as claimed in claim 1, wherein the first cushion comprises a first set of protrusions being positioned at predefined positions on an inner surface of the first cushion such that a first set of depressions are formed between the first set of protrusions.

3. The dual helmet as claimed in claim 2, wherein the second cushion comprises a second set of protrusions being positioned at predefined positions on an inner surface of the second cushion such that a second set of depressions are formed between the second set of protrusions.

4. The dual helmet as claimed in claim 3, wherein, when the second cushion is disposed within the first cushion to form the protective cushion arrangement, the first set of protrusions of the first cushion engages with the second set of depressions of the second cushion, and the second set of protrusions of the second cushion engages with the first set of depressions of the first cushion.

5. The dual helmet as claimed in claim 1, wherein at least one of the first cushion and the second cushion bends, to facilitate the removal of the second cushion from the first cushion.

6. The dual helmet as claimed in claim 1, wherein any or a combination of the first shell, and the second shell comprises a lock arrangement configured to lock the second shell in the second position, and lock the first shell with the second shell to provide the combined helmet.

7. The dual helmet as claimed in claim 1, wherein the dual helmet comprises a first strap and a second strap removably coupled to each other to form a combined strap, and retain any or a combination of the first helmet, the second helmet, and the combined helmet, respectively, over the head of the users.

8. The dual helmet as claimed in claim 7, wherein the first strap is connected with the first helmet, the second strap is connected with the second helmet, and the combined strap is connected with the combined helmet.

9. The dual helmet as claimed in claim 7, wherein each of the first strap and the second strap comprises ear cavities to accommodate ears of the users, and wherein the first strap and the second strap are removably coupled to each other.

10. The dual helmet as claimed in claim 1, wherein the dual helmet comprises a comfort foam that is removably disposed within any or a combination of the first cushion, and the second cushion, and wherein the dual helmet comprises a face protector that is removably coupled to any or a combination of the first helmet, the second helmet, and the combined helmet.

* * * * *